United States Patent [19]

Carlqvist

[11] 4,365,474

[45] Dec. 28, 1982

[54] MODULE FOR CONSTRUCTING A DOUBLE-ACTING FOUR-CYLINDER STIRLING ENGINE

[75] Inventor: Stig G. Carlqvist, Malmö, Sweden

[73] Assignee: CMC Aktiebolag, Malmö, Sweden

[21] Appl. No.: 151,863

[22] Filed: May 21, 1980

[30] Foreign Application Priority Data

Jun. 19, 1979 [SE] Sweden ..... 7905378

[51] Int. Cl.[3] ..... F02G 1/04

[52] U.S. Cl. ..... 60/525; 60/526

[58] Field of Search ..... 60/517, 525, 526; 62/6

[56] References Cited

U.S. PATENT DOCUMENTS 4,016,720 4/1977 Meijer ..... 60/525 X 4,055,953 11/1977 Nederlof ..... 60/517 X 4,267,696 5/1981 Lindskoug ..... 60/526

*Primary Examiner*—Allen M. Ostrager

*Assistant Examiner*—Stephen F. Husar

*Attorney, Agent, or Firm*—Beveridge, DeGrandi & Kline

[57] ABSTRACT

A module for a double-acting four-cylinder Stirling engine includes a heater, two upper cylinder portions, two regenerator/cooler units which each have a flexibly interconnected regenerator and a cooler, two heater tube systems and two cooler tube systems. The upper cylinder portions and the regenerators extend into the heater, and are sealed and affixed thereto. The upper cylinder portions are connectible to two lower cylinder portions affixed to an engine block. The coolers are connectible to two lower cylinder portions affixed to the block. Each of the heater tube systems extends in the heater module from a respective upper cylinder portion to one of the regenerators of the engine; and, each of the cooler tube systems extends from a regenerator, through its respective cooler and through the cooler wall for connection to one of the lower cylinder portions.

6 Claims, 7 Drawing Figures

MODULE FOR CONSTRUCTING A DOUBLE-ACTING FOUR-CYLINDER STIRLING ENGINE

The present invention relates to a module for the construction of a double-acting four-cylinder Stirling engine which has a heater means for heating the working gas of the engine; an engine block in which the four cylinders of the engine are fixedly anchored; a piston arranged in each cylinder and dividing the interior of the respective cylinder into an upper hot space and a lower cold space; a regenerator/cooler unit associated with each cylinder and consisting of an upper regenerator and a lower cooler which is connected to the regenerator; a heater tube system associated with each cylinder and extending from the upper hot space of the respective cylinder through the heater means and into the regenerator of the regenerator/cooler unit associated with the cylinder; and a cooler tube system associated with the regenerator/cooler unit of each cylinder and extending from the interior of the regenerator through the cooler and into the lower cold space of the next cylinder, the cylinders, the heater tube systems, the regenerator/cooler units and the cooler tube systems forming a completely closed system in which the working gas by means of the pistons is continuously moved back and forth between the upper hot space of the respective cylinder and the lower cold space of the next cylinder.

In a double-acting Stirling engine the cylinder pistons move working gas back and forth between a hot side and a cold side and transfer mechanical work to a drive shaft. The pistons of a double-acting Stirling engine are thermodynamically coordinated and each piston simultaneously operates in two cycles, the hot upper side of a piston cooperating with the cold underside of the next piston. This means that the Stirling engine must have at least three cylinders with cooperating pistons. Optimum effect is obtained with 4–6 cylinders. The working gas is continuously moved back and forth between the hot space above the piston in one cylinder and the cold space beneath the piston in the next cylinder. Between these spaces the working gas flows through a heater means, a regenerator and a cooler. Heat is supplied to the working gas in the heater means. The regenerator gives off heat to the working gas when it is moved from the cold side to the hot side, and stores heat when the working gas is moved in the opposite direction. The cooler takes up the heat produced during compression of the working gas. The temperature of the working gas will hereby be kept substantially constant on both the hot and the cold side.

A double-acting four-cylinder Stirling engine should meet the following requirements and desiderata:

(1) The connections between the upper hot spaces of the cylinders and the regenerators should be so arranged in the heater means that there is obtained a suitable surface for heat transfer.

(2) The connections between the lower cold spaces of the cylinders and the coolers should be of short length, i.e. their volume should be in a reasonable proportion to the cylinder volume, and all be of equal length.

(3) The four piston rods should be mechanically interconnected by means of a single element which should be of simple construction based on known technique, and consist of, for example, a crankshaft of conventional type.

(4) A simple and compact construction of the cylinders and the regenerator/cooler units is desirable. It should be easy to perform divisions between the hot and cold spaces of the cylinder block.

(5) The friction losses of the mechanical power transmission must be kept low, for which reason the number of movable parts and bearing surfaces should be minimized.

The copending U.S. patent application Ser. No. 28,019 filed Apr. 6, 1979, now U.S. Pat. No. 4,307,569, discloses a double-acting four-cylinder Stirling engine which satisfies the above-mentioned requirements and desiderata. This Stirling engine has, with regard to the location of the cylinders and of the regenerator/cooler units, a particularly favorable geometric structure which is schematically shown in FIGS. 2 and 3. The cylinders ae arranged in a row, following upon each other along a straight line, the distances between adjacent cylinders being equal. The regenerator/cooler units are disposed outside the cylinders and are uniformly distributed over a circle, the axis of which passes through a point midway between the two intermidiary cylinders and intersects the straight line at right angles.

Such a Stirling engine further has a rotationally symmetric combustor which only permits use of gaseous, liquid and to some extent pulverulent fuels. The heater tubes of the engine should be arranged in the combustor in a rotationally symmetric fashion, which requires a relatively complicated tube arrangement between cylinders and regenerators.

It is desirable to provide a Stirling engine having the above-defined or another geometrical construction with respect to the location of the cylinders and the regenerator/cooler units, with a heater means which permits use not only of gaseous, liquid or pulverulent fuels but also of solid fuels and heat accumulators, i.e. that permits use of thermal energy of any kind, and which allows a simple tubing arrangement between cylinders and regenerators.

To this end, it is possible to use as heater means a known so-called heat pipe (FIG. 4) in which the cyclic evaporation and condensation of a medium is used for heat transfer. A heat pipe may in principle be divided into three parts, viz. an evaporation part, in which heat is supplied, a condensation part, in which heat is emitted, and a transfer part, in which the medium is transported in gaseous form in one direction and in liquid form in the opposite direction. The heat pipe carries internally a so-called wick which consists of porous material being capable of transporting liquid under capillary action. When heat is supplied in the evaporation part, liquid conveyed to the condensation part by the wick evaporates, the resulting gas according to the "cold wall principle" being transferred very rapidly to the condensation part in which heat is given off, such that the gas condenses. The condensed liquid is transferred by the wick back to the condensation part where it again evaporates and so on. By choosing a suitable medium in the heat pipe, it is possible to create almost isothermal conditions at a working temperature of 700°–900° C. suitable for Stirling engines. At this temperature the temperature difference in the heat pipe is as low as about 5° C. A suitable medium is pure sodium or a eutectic of sodium and other substances. The heat source intended for the supply of heat to the heat pipe and thus the fuel may be freely selected as long as the proper working temperature may be maintained. Since the heat transfer in a heat pipe may rapidly be effected and with small thermal losses, there is great freedom of choice for the location of the heat source.

If a Stirling engine is provided with a heat pipe of the above-defined type as heater means and the heater tubes of the engine are then disposed in the condensation part of the heat pipe, isothermal conditions may be obtained in the hot space of the engine, the internal flow pattern of the working medium of the engine in the heater tubes may be improved so as to obtain a reduction in flow losses and thus enhanced engine power and efficiency, and heat sources for solid fuels and heat accumulators with stored heat may also be used for heating the heater means. When using heat accumulators there is no need of air for the engine and the engine may run without emitting any exhaust gases.

In the above combination of a Stirling engine and heat pipes, certain requirements and desiderata must be satisfied. Since the heat pipe which houses the heater tubes of the engine contains liquid and gaseous medium at a working temperature of 700°–900° C. suitable for a Stirling engine, high demands must be placed on the hermetic enclosure of this medium. Particular difficulties are here linked with the openings that must be provided in the wall of the heat pipe in order that the cylinders and the regenerators of the engine may be interconnected by the respective heater tubes. From the point of view of manufacture and maintenance, it is desirable that the heater means, the heat pipe, is divided into suitable modules. Regard must be paid to the effects of thermal expansion, since the hot spaces of the engine expand considerably and its cold spaces expand to a minor extent. This is also the case, when the heater means is divided into separate modules.

The object of the present invention is to provide a module for the construction of a double-acting four-cylinder Stirling engine in which the above-mentioned requirements and desiderata, in particular as regards the thermal expansion problems, will be satisfied.

This object is achieved according to the present invention by the provision of a module which is of the type described by way of introduction and which is characterized by a heater module (*7'a, 7'b; 7''a, 7''b*) which constitutes one of two separate heater units forming the heater means of a Stirling engine; two upper cylinder portions (1'a–1'd) which extend into the heater module, are sealingly and fixedly connected thereto and each adapted to be rigidly connected to a lower cylinder portion (1'a–1'd) fixedly anchored to the engine block (B) to form two of the four cylinders (1a–1d) of the engine; two regenerator/cooler units (3a–3d) associated with each of said two cylinders and the regenerators (4a–4d) of which extend into the heater module, are sealingly and fixedly connected thereto and flexibly connected to the respective cooler (5a–5d) and the coolers of which are adapted to be fixedly connected each to a lower cylinder portion (1''a–1''d) fixedly anchored to the engine block, to connect the respective cooler tube system (8'a–8'd; 8''a–8''d) thereto; two heater tube systems (6'a–6'd; 6''a–6''d) associated with each of said two cylinders and located in the heater module and connecting said two upper cylinder portions to the respective regenerator; and a plurality of flexible first cooler tubes ($8'a_1$–$8'd_1$; $8''a_1$–$8''d_1$), included in the respective cooler tube system, in each of said two regenerator/cooler units, said cooler tubes being fixedly connected to the respective regenerator, extending from the interior of the regenerator to the respective cooler and out through the wall thereof and being fixedly connected thereto.

In a double-acting four-cylinder Stirling engine which is made up of two modules according to the present invention, each regenerator and the upper cylinder portion of each cylinder are thus fixedly connected to the respective heater module, while each cooler is flexibly connected to the respective regenerator but fixedly connected to the lower cylinder portion of the respective cylinder. The demand for hermetic sealing of the working medium of the engine and the cooling medium of the engine may be satisfied at the same time as thermal expansion movements may be absorbed in that the cooler and the regenerator are flexibly interconnected and in that the cooler tubes in the cooler are flexible.

The invention will now be described in greater detail with reference to the accompanying drawings.

FIG. 1 schematically shows the operating principle of a double-acting four-cylinder Stirling engine.

FIG. 2 schematically shows a cylinder arrangement in a Stirling engine according to Swedish patent application No. 7810529-3 in top plan view.

FIG. 3 schematically shows another cylinder arrangement in a Stirling engine according to Swedish patent application No. 7810529-3 in top plan view.

Figure 3:
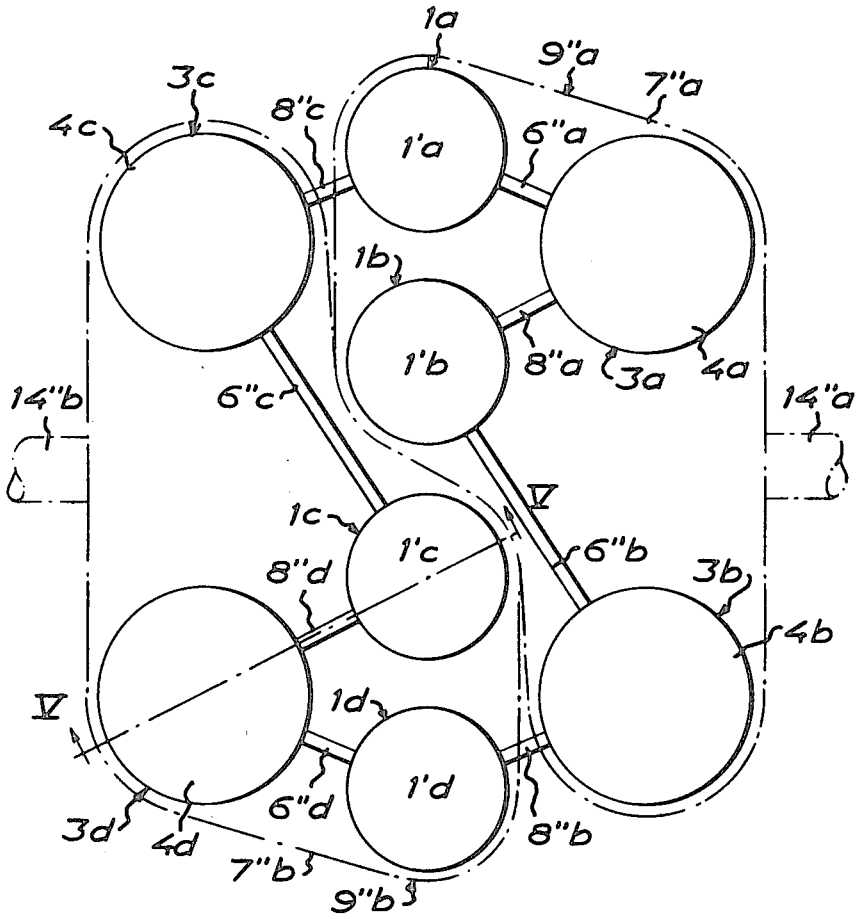
Figure 6:
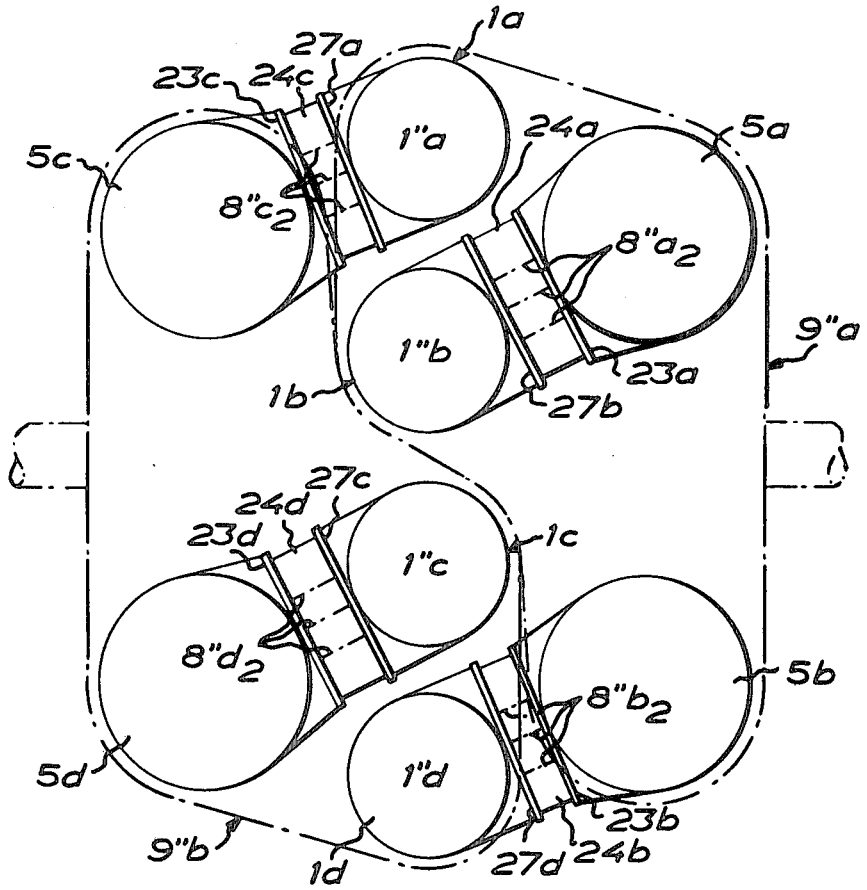

FIG. 6 schematically shows connecting pieces between cylinders and coolers in two modules corresponding to the cylinder arrangement in FIG. 3.

Figure 2:
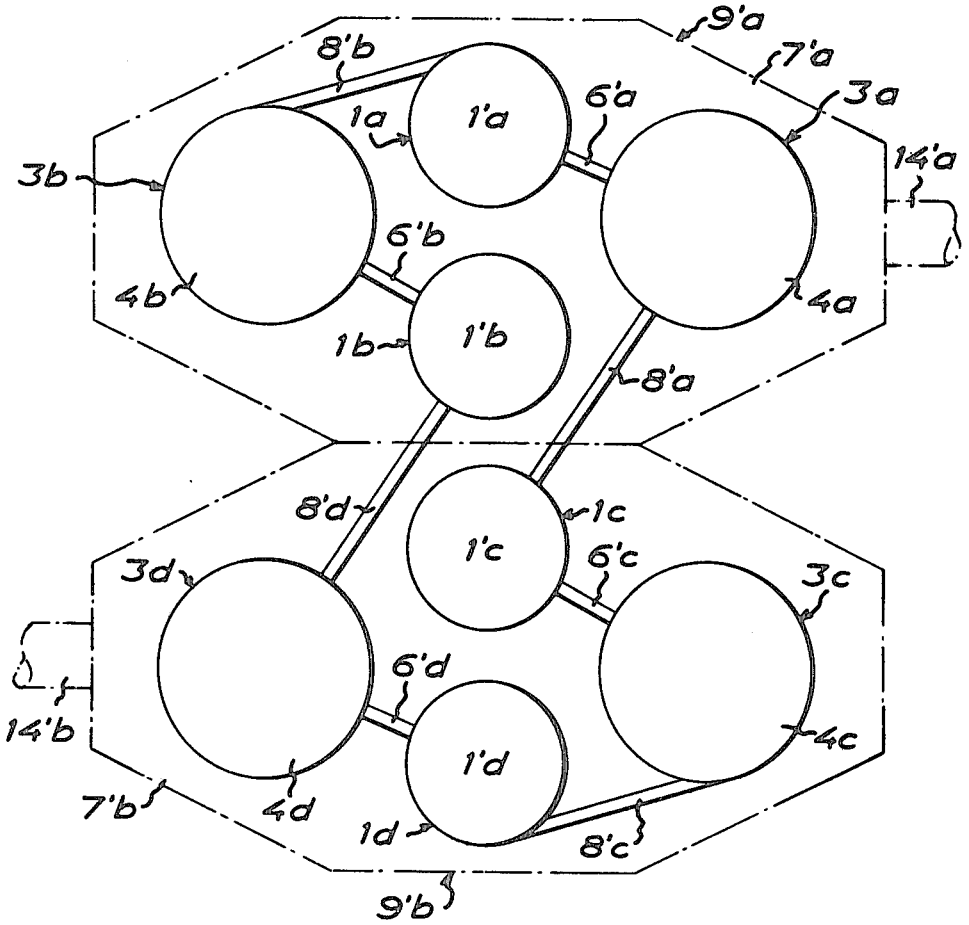
Figure 7:
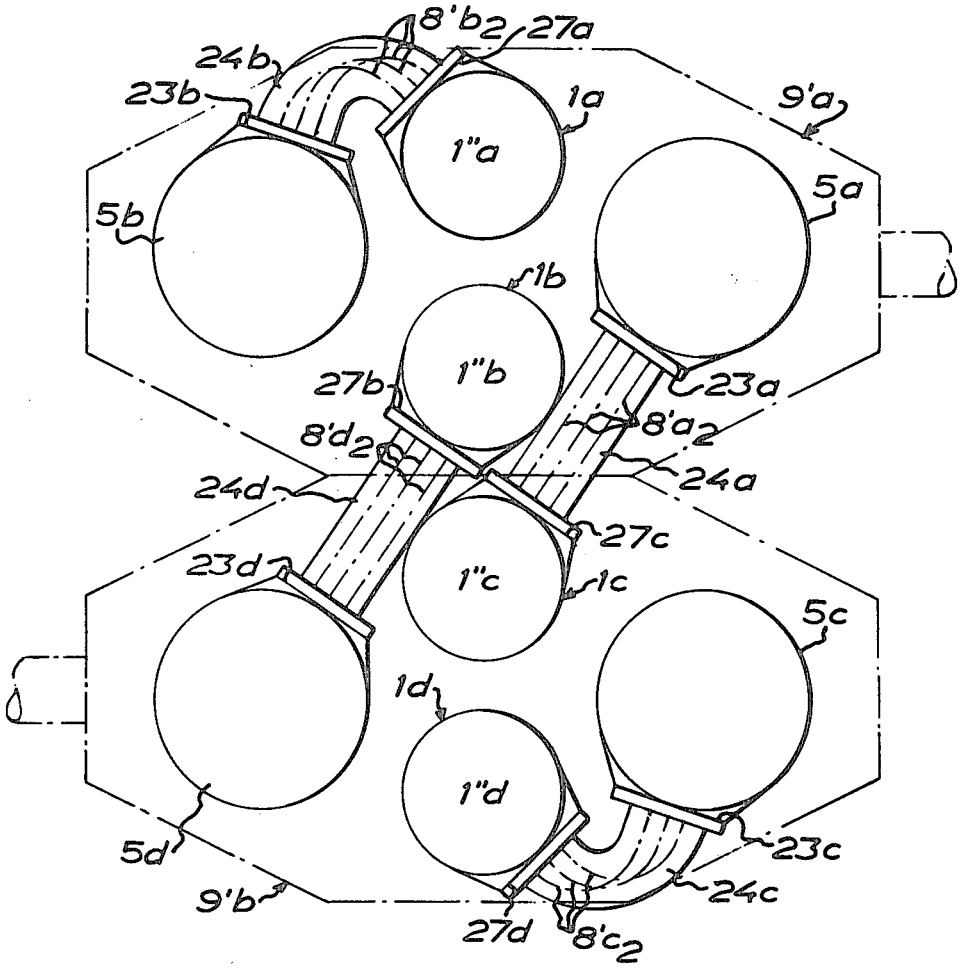

FIG. 7 schematically shows connecing pieces between cylinders and coolers in two modules corresponding to the cylinder arrangement in FIG. 2.

The engine module according to the present invention will be described in connection with a Stirling engine which has the geometric design shown in FIGS. 2 and 3 with regard to the location of the cylinders and the regenerator/cooler units. As will be appreciated, the invention is of course not restricted to a Stirling engine of this geometric design.

Figure 1:
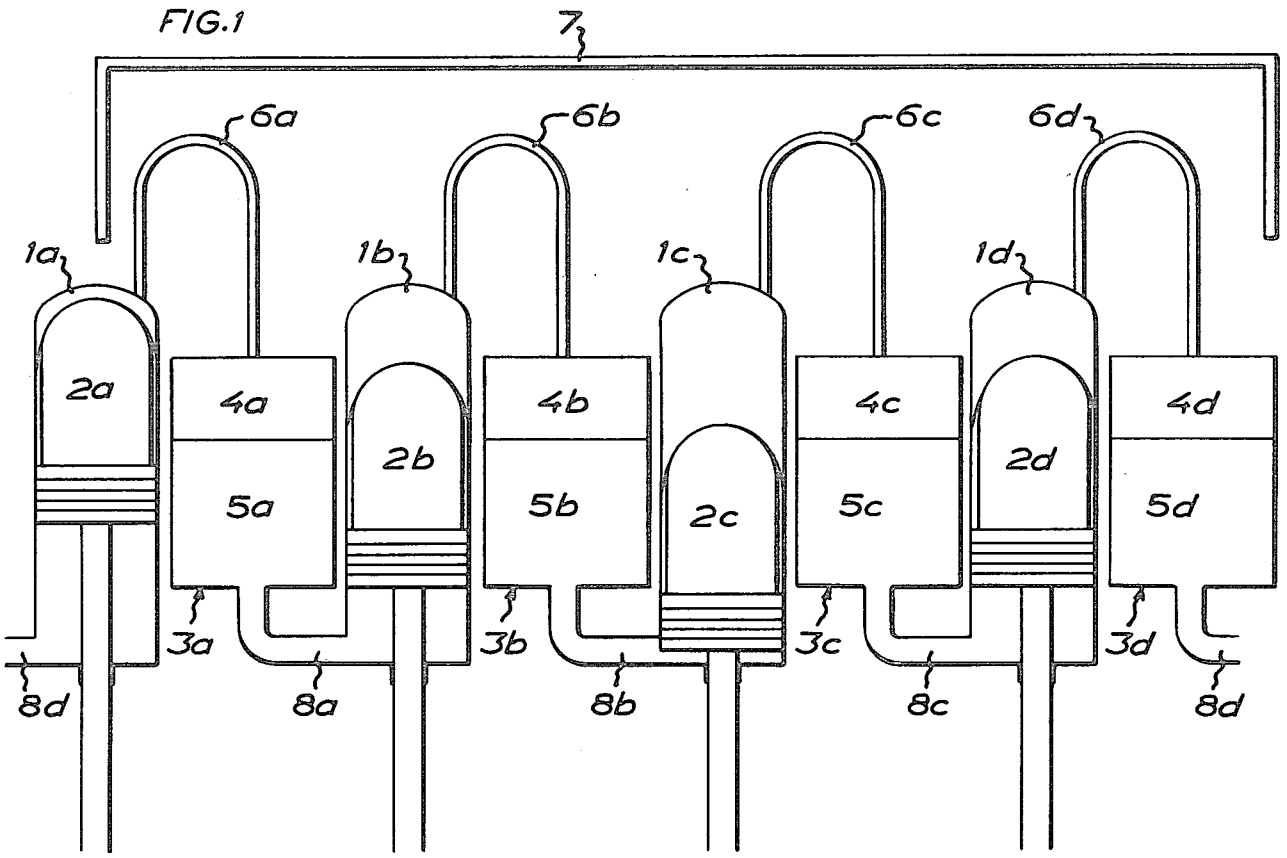

Before a module according to the present invention which is intended for constructing a double-acting four-cylinder Stirling engine will be described in greater detail, the principle on which a double-acting four-cylinder Stirling engine functions will first be described with reference to FIG. 1 which shows four cylinders 1a, 1b, 1c, 1d with associated pistons 2a, 2b, 2c and 2d, respectively. Associated with each cylinder 1a, 1b, 1c, 1d is also a regenerator/cooler unit 3a, 3b, 3c and 3d, respectively, which consists of an upper regenerator 4a, 4b, 4c and 4d, respectively, and a lower cooler 5a, 5b, 5c and 5d, respectively, which are in communication with each other. Each cylinder 1a–1d above the respective piston 2a–2d has an upper hot space and below the respective piston 2a–2d a lower cold space.

The hot spaces of the cylinders 1a, 1b, 1c, 1d communicate via a heater tube system 6a, 6b, 6c and 6d, respectively, with the respective regenerator 4a–4d. Each heater tube system 6a–6d extends upwards into a heater means 7. The cooler 5a, 5b, 5c and 5d of each cylinder 1a, 1b, 1c and 1d, respectively, commnunicates via a cooler tube system 8a, 8b, 8c and 8d, respectively, with the cold space of the next cylinder 1b, 1c, 1d and 1a, respectively. The cylinders 1a–1d, the heater tube systems 6a–6d, the regenerator/cooler units 3a–3d and the cooler tube systems 8a–8d thus form a wholly closed system in which working gas, usually hydrogen or helium, is contained. The working gas is moved by the respective piston 2*a*–2*d* continuously back and forth between the hot space of a cylinder 1*a*–1*d* and the cold space of the next cylinder. In the heater tube systems 6*a*–6*d* in the heater means 7 heat is then supplied to the working gas. The regenerators 4*a*–4*d* give off heat to the working gas when it is moved from cold space to hot space, and store heat when the working gas is moved from hot space to cold space. The coolers 5*a*–5*d* take up the heat produced during the compression of the working gas. The temperature of the working gas will hereby be kept substantially constant on both the hot side and the cold side.

In the cylinder arrangement illustrated in FIG. 2, the four cylinders 1*a*–1*d* are arranged in a row along a straight line, the distances between adjacent cylinders being equal. The four regenerator/cooler units 3*a*–3*d* are uniformly distributed over a circle, the axis of which passes through a point midway between the two intermediary cylinders 1*b* and 1*c* and intersects the straight line at right angles.

Each cooler 5*a*, 5*b*, 5*c*, 5*d* communicates via a cooler tube system 8'*a*, 8'*b*, 8'*c* and 8'*d*, respectively, with the cold space of the next cylinder 1*c*, 1*a*, 1*b*, respectively. The four cooler tube systems 8'*a*–8'*d* are substantially of equal length.

The hot space of each cylinder 1*a*, 1*b*, 1*c*, 1*d* is in communication with the respective regenerator 4*a*–4*d* via a heater tube system 6'*a*, 6'*b*, 6'*c* and 6'*d*, respectively, which extends upwards into the heater means.

The cylinder arrangement shown in FIG. 3 differs from that illustrated in FIG. 2 in that the regenerator/cooler units 3*b* and 3*c* have changed places and in that the coolers 5*a*, 5*b*, 5*c* and 5*d* by means of cooler tube systems 8''*a*, 8''*b*, 8''*c* and 8''*d*, respectively, are connected to the cylinders 1*b*, 1*d*, 1*a* and 1*c*, respectively (FIG. 3), instead of being connected to the cylinders 1*c*, 1*a*, 1*d* and 1*b*, respectively (FIG. 2).

Here it may be pointed out that the heater tube systems 6'*a*–6'*d* and 6''*a*–6''*d* and the cooler tube systems 8'*a*–8'*d* and 8''*a*–8''*d* are shown only schematicall on FIGS. 2 and 3. Thus, these Figures do not show the tubes included in the different systems and how these tubes extend between the respective elements, but only illustrate which elements are connected with each other on both the cold and the hot side.

As will appear from FIGS. 2 and 3, the sequence of the cylinders, in which the thermodynamic cycle takes place, or "the firing order" is, in the arrangement according to FIGS. 2, *a-b-d-c* and, in the arrangement according to FIGS. 3, *a-c-d-b*. These sequences allow the utilization of suitably designed conventional crankshafts.

The cylinder arrangements illustrated in FIGS. 2 and 3 may be modified in many different ways by changing the order of the regenerator/cooler units 3*a*–3*d* over the circle and by connecting the coolers 5*a*–5*d* to the cylinders 1*a*–1*d* in another sequence. In this way, other "firing orders" can be realized which also allow the utilization of suitably designed conventional crankshafts.

In FIGS. 2 and 3, the heater means 7'*a*, 7'*b* and 7''*a*, 7''*b*, respectively, of the respective engine are shown by dash-dotted lines, the heater means consisting of two identical heater modules 7'*a* and 7'*b*, 7''*a* and 7''*b*, respectively, forming separate heater units. The heater modules 7'*a*, 7'*b*, 7''*a*, 7''*b* are included each in one engine module 9'*a*, 9'*b*, 9''*a* and 9''*b*, respectively, according to the present invention. Each engine module pair consists of two identical engine modules. The elements pertaining to each engine module can be found within the area in FIGS. 2 and 3 that is defined by the dash-dotted lines corresponding to the respective heater module.

Figure 4:
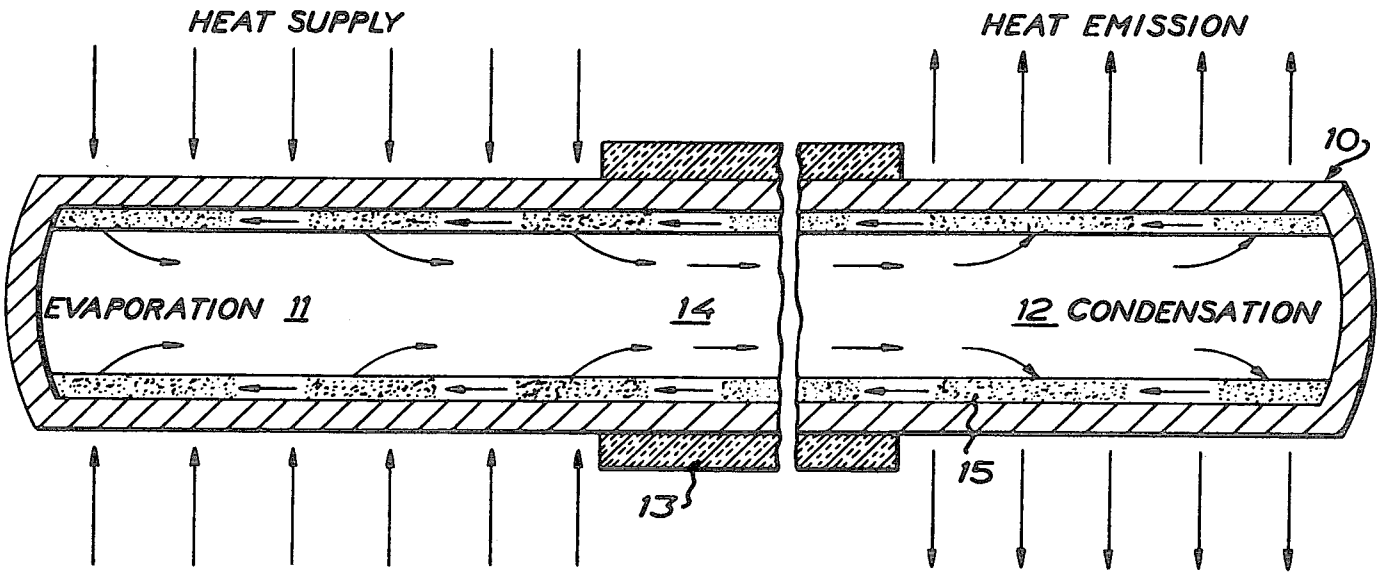
FIG. 4 shows a heat pipe of known type.

Each heater module corresponds to the condensation part in a so-called heat pipe in which the cyclic evaporation and condensation of a medium is used for heat transfer. A heat pipe 10 will now be described in greater detail with reference to FIG. 4. The heat pipe 10 which is closed at both ends may in principle be divided into three parts, namely an evaporation part 11 in which heat from a heat source (not shown) of any suitable type is supplied to the heat pipe, a condensation part 12 in which heat is emitted, and a transfer part 14 provided with a surrounding insulation 13 and in which the medium is conveyed in gaseous form in one direction (to the right in FIG. 4) and in liquid form in the opposite direction (to the left in FIG. 4). The heat pipe 10 carries internally and over its entire length a so-called wick 15 which consists of porous material capable of transporting liquid under capillary action. When heat is supplied at the evaporation part 11, liquid transferred to the evaporation part by the wick 15 vaporizes, the resulting gas according to the "cold wall principle" being then transferred very rapidly to the condensation part 12 where heat is given off, such that the gas condenses. The condensed liquid is conveyed by the wick 15 to the evaporation part 11 where it again vaporizes, and so on.

As mentioned above, each heater module 7'*a*, 7'*b*, 7''*a*, 7''*b* corresponds to the condensation part in a heat pipe. Each heater module 7'*a*, 7'*b*, 7''*a*, 7''*b* communicates with an evaporation part (not shown in FIGS. 2 and 3) via a heat-insulated transfer part 14'*a*, 14'*b*, 14''*a* 14''*b*, respectively. The heater modules are also heat-insulated. By choosing a suitable medium in the heat pipe, it is possible to obtain almost isothermal conditions at a working temperature of 700°–900° C. suitable for a Stirling engine. A suitable medium is pure sodium or a eutectic of sodium or other substances. The heater modules are disposed above the other elements of the respective engine module. The heater tube systems 6'*a*–6'*d*, 6''*a*–6''*d* of each engine module are arranged in the manner described in greater detail below in the respective heater module in order there to receive heat for heating the working gas of the engine.

Figure 5:
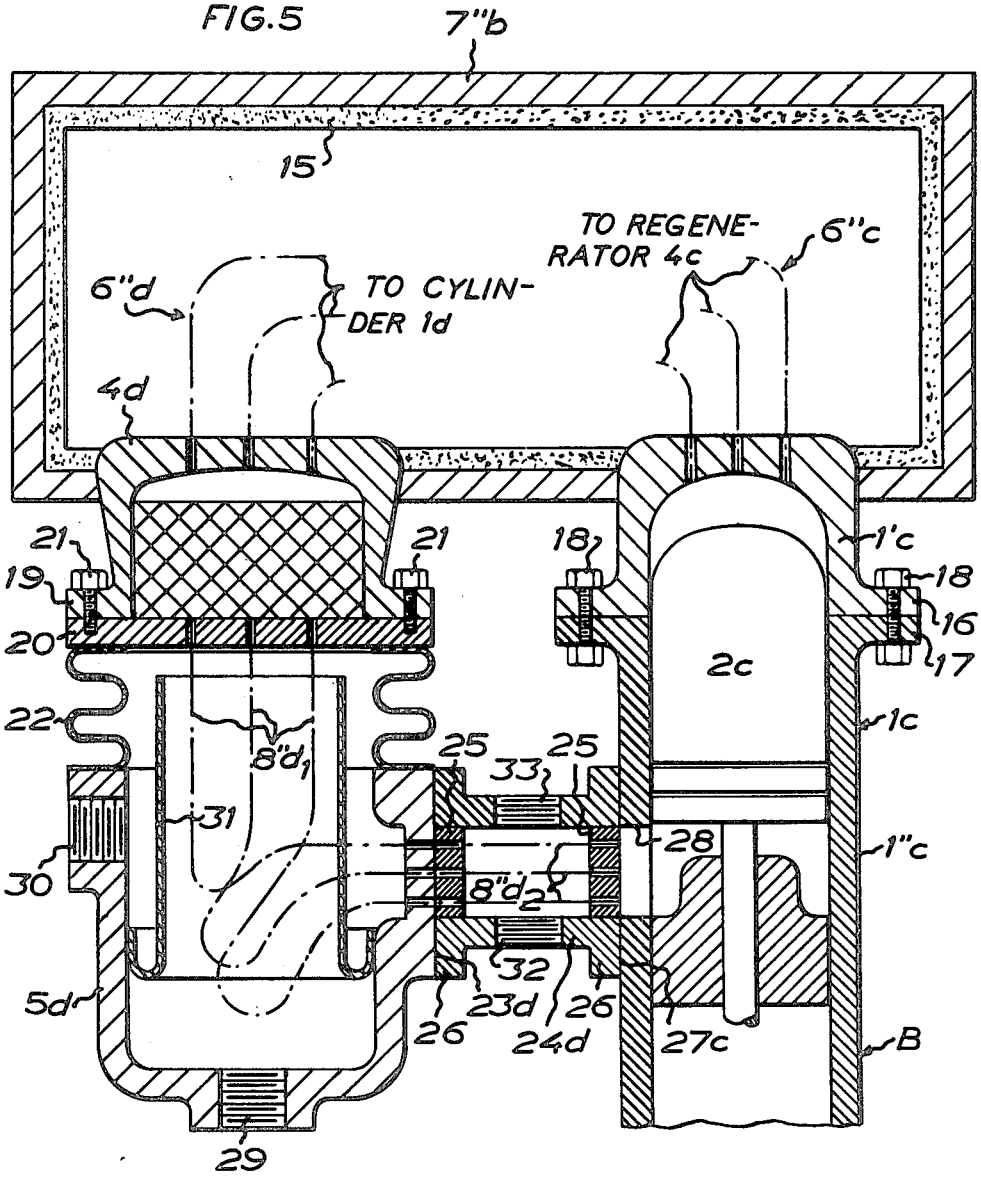
FIG. 5 shows a module according to the present invention in sectional view along line V—V in FIG. 3.

An engine module according to the present invention will now be described in greater detail with reference to FIG. 5 showing one engine module of the cylinder arrangement in FIG. 3, in sectional view along line V—V in FIG. 3. In FIG. 5 is shown the heater module 7''*b* of the engine module 9''*b*. As earlier mentioned, the heater module 7''*b* corresponds to the condensation part in a heat pipe and is therefore provided with an internal lining of porous material which is capable of transferring liquid under capillary action and forms the wick 15 of the heat pipe. The heater module 7''*b* has a suitable external heat insulation (not shown).

The cylinder 1*c* is divided into an upper cylinder portion 1'*c*, being part of the engine module 9''*b*, and a lower cylinder portion 1''*c* which is provided in the engine block B and not included in the engine module 9''*b*. The upper cylinder portion 1'*c* extends into the heater module 7''*b* and is sealingly and fixedly soldered to the lower wall thereof. The upper cylinder portion 1'*c* has a lower flange 16 and the lower cylinder portion 1''*c* has an upper flange 17 for rigid interconnection of the cylinder portions 1'c and 1''c by means of bolts 18. A seal is suitably disposed between the flanges 16 and 17.

The regenerator 4d of the regenerator/cooler unit 3d, which is part of the engine module 9''b, extends into the heater module 7''b and is fixedly connected to the lower wall thereof in the same way as the upper cylinder portion 1'c. The regenerator 4d has a lower flange 19 and is secured to a bottom place 20 of metal by means of bolts 21 which extend through the flange 19 and a seal (not shown) and into the plate 20.

The cooler 5d of the regenerator/cooler unit 3d is flexibly connected to the plate 20 by bellows means 22 of metallic material which is sealingly soldered to the cooler 5d and the plate 20.

A plurality of flexible first cooler tubes 8''$d_1$ of substantially equal length, three of which are shown schematically by dash-dotted lines in FIG. 5, sealingly extend from the interior of the regenerator 4d through the bottom plate 20, through the cooler 5d and sealingly through the wall thereof and open at a planar surface 23d designed on the outer side of the cooler 5d. The flexible first cooler tubes 8''$d_1$ are soldered to the bottom plate 20 and the wall of the cooler 5d and form a first part of the cooler tube system 8''d.

A tubular connecting piece 24d is provided with end plates 25 fixedly soldered into the ends of the piece 24d and contains a plurality of second through cooler tubes 8''$d_2$ which sealingly extend through the end plates 25 and three of which are schematically illustrated by dash-dotted lines in FIG. 5. The second cooler tubes 8''$d_2$ form a second part of the cooler tube system 8''d. The connecting piece 24d has end flanges 26 which are fixedly connected to the planar surface 23d of the cooler 5d and to a planar surface 27c on the outer side of the lower cylinder portion 1''c in order, via the second cooler tubes 8''$d_2$ and a through opening 28 provided in the planar surface 27c, to connect the flexible first cooler tubes 8''$d_1$ to the interior of the lower cylinder portion 1''c. The connecting piece 24d is suitably fixed to the cooler 5d and the lower cylinder portion 1''c by means of bolts (not shown) which extend through the respective end flange 26 and an intermediary seal (not shown) into the connecting surface 23d and 27c, respectively.

The cooler 5d has an inlet 29 and an outlet 30 for a coolant, usually water, for primary cooling of the working gas of the engine. This primary cooling is in respect of temperature restricted to about 60°–80° C., which makes it possible to use the coolant e.g. for heating purposes. In the cooler 5d there is also provided a water baffle plate 31.

The connecting piece 24d has an inlet 32 and an outlet 33 for a coolant, usually water, for secondary cooling of the working gas of the engine. This secondary cooling is effected with a coolant at a lower temperature, about 20° C., which means that the thermodynamic temperature drop in the Stirling process increases and greater efficiency is obtained.

The hot space of the cylinder 1c communicates via a plurality of heater tubes which form the heater tube system 6''c of this cylinder and three of which are illustrated schematically by dash-dotted lines in FIG. 5, with the interior of the regenerator 4c included in the same engine module 9''b (see FIG. 3). In the same manner, the interior of the regenerator 4d communicates via a plurality of heater tubes which form the heater tube system 6''d of the cylinder 1d in the same engine module 9''d (see FIG. 3) and three of which are schematically illustrated by dash-dotted lines in FIG. 5, with the hot space of the cylinder 1d. The heater tubes sealingly extend into the respective cylinder and regenerator and are secured thereto by soldering. The distance between the cylinder 1d and the regenerator 4d in the cylinder arrangement according to FIG. 3 is shorter than the distance between the cylinder 1c and the regenerator 4c. By profiting from the freedom afforded by the utilization of heat pipes as heater means, the heater tubes in the two heater tube systems 6''c and 6''d may however readily be given the same length, for instance as shown in FIG. 5, in which an "extension" of the heater tubes of the heater tube system 6''d is schematically shown. In the arrangement of heater tubes in the heater module, the following requirements should be met: The heater tubes should be of sufficient length to give a surface suitable for heat transfer and should be of simple geometry. Furthermore, all the heater tubes should be of equal length.

The engine modules 9''a and 9''b are identical and coupled together in that the cooler 5b of the module 9''a is connected by means of a connecting piece 24b to the lower cylinder portion 1''d, of the cylinder 1d, which is provided in the engine block B, and in that the cooler 5c in the module 9''b is connected, by means of a connecting piece 24c, to the lower cylinder portion 1''a, of the cylinder 1a, which is provided in the engine block B. "Within the area" of the respective module, the cooler 5a in the module 9''a and the cooler 5d in the module 9''b are connected, by means of a connecting piece 24a and 24d, respectively (see FIG. 6), to the lower cylinder portions 1''b and 1''c, respectively, of the cylinder 1b and 1c, respectively, that are provided in the engine block B.

As stated above, the cylinder arrangements illustrated in FIGS. 2 and 3 differ from each other in that the regenerator/cooler units 3b and 3c have changed places and in that the coolers 5a, 5b, 5c and 5d by means of the cooler tube systems are connected to the cylinders 1c, 1a, 1b, respectively, in FIG. 2 and to the cylinders 1b, 1d, 1a and 1c, respectively, in FIG. 3. This means that the engine modules 9'a and 9'b which are identical and which comprise the same upper cylinder portions and the same regenerator/cooler units as the corresponding engine module 9''a and 9''b, respectively, and the heater modules 7'a and 7'b, which are also identical, have a different design as compared with the engine modules 9''a and 9''b and the heater modules 7''a and 7''b. Since the engine modules 9'a, 9'b and the heater modules 7'a, 7'b in other respects entirely correspond to the engine modules 9''a, 9''b and the heater modules 7''a, 7''b, respectively, these elements will not be described in greater detail in this context.

As will be appreciated from FIGS. 2 and 7, the distance between the coolers 5a and 5d and the corresponding cylinder 1c and 1b, respectively, is greater than the distance between the coolers 5b and 5c and the corresponding cylinder 1a and 1d, respectively. In order that the cooler tube systems 8'a, 8'b, 8'c and 8'd consisting of flexible first cooler tubes 8'$a_1$, 8'$b_1$, 8'$c_1$, 8'$d_1$ and second cooler tubes 8'$a_2$, 8'$b_2$, 8'$c_2$, 8'$d_2$, respectively, may be kept equally long, all of the connecting pieces 24a–24d are not straight, as in the engine modules 9''a, 9''b, but the connecting pieces 24b and 24c are curved. For this reason, the connecting surface 23b and 23c of the coolers 5b and 5c, respectively, is not located opposite the connecting surface 27a and 27d of the corresponding lower cylinder portion 1″*a* and 1″*d*, respectively.

The engine modules 9′*a* and 9′*b* are identical and interconnected in that the cooler 5*a* in the module 9′*a* is connected, by means of the connecting piece 24*a*, to the lower cylinder portion 1″*c*, of the cylinder 1*c*, which is provided in the engine block B, and in that the cooler 5*d* in the module 9′*b* is connected, by means of the connecting piece 24*d*, to the lower cylinder portion 1″*b*, of the cylinder 1*b*, which is provided in the engine block B. "Within the area" of the respective module the cooler 5*b* in the module 9′*a* and the cooler 5*c* in the module 9′*b* are connected, by means of the connecting piece 24*b* and 24*c*, respectively, to the lower cylinder portions 1″*a* and 1″*d*, respectively, of the cylinder 1*a* and 1*d*, respectively, that are provided in the engine block B.

What I claim and desire to secure by Letters Patent is:

1. Module for the construction of a double-acting four-cylinder Stirling engine which has a heater means (7′*a*, 7′*b*; 7″*a*, 7″*b*) for heating the working gas of the engine; an engine block (B) in which the four cylinders (1*a*–1*d*) of the engine are fixedly anchored; a piston (2*a*–2*d*) arranged in each cylinder and dividing the interior of the respective cylinder into an upper hot space and a lower cold space; a regenerator/cooler unit (3*a*–3*d*) associated with each cylinder and comprising an upper regenerator (4*a*–4*d*) and a lower cooler (5*a*–5*d*) which is connected to the regenerator; a heater tube system (6′*a*–6′*d*; 6″*a*–6″*d*) associated with each cylinder and extending from the upper hot space of the respective cylinder through the heater means and into the regenerator of the regenerator/cooler unit associated with the cylinder; and a cooler tube system (8′*a*–8′*d*; 8″*a*–8″*d*) associated with the regenerator/-cooler unit of each cylinder and extending from the interior of the regenerator through the cooler and into the lower cold space of the next cylinder, the cylinders, the heater tube systems, the regenerator/cooler units and the cooler tube systems forming a completely closed system in which the working gas by means of the pistons is continuously moved back and forth between the upper hot space of the respective cylinder and the lower cold space of the next cylinder, characterized by a heater module (7′*a*, 7′*b*; 7″*a*, 7″*b*) which constitutes one of two separate heater units forming the heater means of the Stirling engine; two upper cylinder portions (1′*a*–1′*d*) which extend into the heater module, are sealingly and fixedly connected thereto and each adapted to be rigidly connected to a lower cylinder portion (1″*a*–1″*d*) fixedly anchored to the engine block (B) to form two of the four cylinders (1*a*–1*d*) of the engine; regenerator/cooler units (3*a*–3*d*) associated with each of said cylinders and the regenerators (4*a*–4*d*) of which extend into the heater module, are sealingly and fixedly connected thereto and flexibly connected to the respective cooler (5*a*–5*d*) and the coolers of which are adapted to be fixedly connected each to a lower cylinder portion (1″*a*–1″*d*) fixedly anchored to the engine block, to connect the respective cooler tube system (8′*a*–8′*d*; 8″*a*–8″*d*) thereto; heater tube systems (6′*a*–6′*d*; 6″*a*–6″*d*) associated with each of said cylinders and located in the heater module and connecting said upper cylinder portions to the respective regenerator; and a plurality of flexible first cooler tubes (8′$a_1$–8′$d_1$; 8″$a_1$–8″$d_1$), included in the respective cooler tube system, in each of said to regenerator/cooler units, said cooler tubes being fixedly connected to the respective regenerator, extending from the interior of the regenerator to the respective cooler, said cooler having a wall through which the cooler tubes extend and to which the cooler tubes are fixedly connected.

2. Module as claimed in claim 1, characterized in that the flexible first cooler tubes (8′$a_1$–8′$d_1$; 8″$a_1$–8″$d_1$) form a first part of the respective cooler tube system (8′*a*–8′*d*; 8″*a*–8″*d*) and that connecting pieces (24*a*–24*d*)are associated with each of the coolers (5*a*–5*d*) of said regenerator/cooler units (3*a*–3*d*) for connecting the lower coolers to the lower cylinder portions, each of said connecting pieces having a plurality of second cooler tubes (8′$a_2$–8′$d_2$; 8″$a_2$–8″$d_2$) for connecting the flexible first cooler tubes to a lower cylinder portion, said second cooler tubes forming a second part of the respective cooler tube system (8′*a*–8′*d*; 8″*a*–8″*d*), said connecting pieces being adapted to be fixedly connected to the respective cooler and each to a lower cylinder portion (1″*a*–1″*d*) fixedly anchored to the engine block (B), in order to connect the flexible first cooler tubes to the respective lower cylinder portion.

3. Module as claimed in claim 2, characterized in that each cooler (5*a*–5*d*) has an inlet (29) and an outlet (30) for coolant for primary cooling of the working gas and that each connecting piece (24*a*–24*d*) has an inlet (32) and an outlet (33) for coolant for secondary cooling of the working gas.

4. Module as claimed in any one of claims 1–3, characterized in that the regenerators (4*a*–4*d*) are flexibly connected to the respective cooler (5*a*–5*d*) by bellows means (22).

5. Module as claimed in any one of claims 1–3, characterized in that the heater modules (7′*a*, 7′*b*; 7″*a*, 7″*b*) are a heat pipe in which the cyclic evaporation and condensation of a medium is used for heat transfer.

6. Module as claimed in claim 4, characterized in that the heater modules (7′*a*, 7′*b*; 7″*a*, 7″*b*) are a heat pipe in which the cyclic evaporation and condensation of a medium is used for heat transfer.

* * * * *